United States Patent [19]

Steiner

[11] 4,290,458

[45] Sep. 22, 1981

[54] MULTIPLE LONGITUDINAL TRAVERSING SHED WEAVING APPARATUS

[75] Inventor: Alois Steiner, Rieden, Switzerland

[73] Assignee: Rüti Machinery Works Ltd., Zurich, Switzerland

[21] Appl. No.: 96,776

[22] Filed: Nov. 23, 1979

[30] Foreign Application Priority Data

Dec. 7, 1978 [CH] Switzerland ..... 12511/78

[51] Int. Cl.[3] ..... D03C 13/00

[52] U.S. Cl. ..... 139/28; 139/11

[58] Field of Search ..... 139/11 R, 11 A, 28, 139/190, 191

[56] References Cited

U.S. PATENT DOCUMENTS 2,893,440 7/1959 Brusadelli ..... 139/28

3,848,642 11/1974 Steiner ..... 139/28

FOREIGN PATENT DOCUMENTS 277634 10/1971 U.S.S.R. ..... 139/11 A

*Primary Examiner*—Henry Jaudon

*Attorney, Agent, or Firm*—Werner W. Kleeman

[57] ABSTRACT

Amultiple longitudinal traversing shed weaving apparatus comprises a weaving rotor having beating elements for the laid or inserted weft threads and shed-retaining elements which retain the warp threads, throughout a predetermined path, in their upper shed position and lower shed position. Each intermediate space between neighboring beating or beat-up elements has operatively associated therewith a respective shed-retaining element which determines the upper shed position or lower shed position and, viewed in the direction of travel of the warp threads, there is arranged forwardly of the weaving rotor a control means for the lateral deflection and selective allocation of the warp threads to a shed-retaining element which determines the upper shed position or lower shed position. Between each two respective beat-up elements, following one another in the direction of rotation of the weaving rotor, there is arranged at the weaving rotor a respective guide element for the warp threads, whose line of alignment is located within the intermediate space between beat-up elements neighboring one another in the weft direction.

19 Claims, 6 Drawing Figures

MULTIPLE LONGITUDINAL TRAVERSING SHED WEAVING APPARATUS

CROSS-REFERENCE TO RELATED CASE

This application is related to my commonly assigned, copending U.S. application Ser. No. 096,777, filed Nov. 23, 1979, entitled "Multiple Longitudinal Traversing Shed Weaving Apparatus".

BACKGROUND OF THE INVENTION

The present invention generally relates to the weaving art and, more specifically, relates to a new and improved construction of a so-called multiple longitudinal traversing shed weaving apparatus or loom, meaning a loom wherein a plurality of successive sheds are formed and retained to establish waves of sheds which travel longitudinally of the warp threads. Such type looms have also been referred to in the art as warp-wave looms, in order to distinguish the same from the type of loom using "weft waves" traveling transversely of the warp threads.

Generally speaking, the multiple longitudinal traversing shed weaving apparatus or loom of the present development is of the type comprising a weaving rotor which is provided with shed-retaining elements or members which retain the warp threads throughout a predetermined path, in their upper shed position or lower shed position and further is equipped with beat-up or beating elements which beat the inserted weft thread.

Multiple longitudinal traversing shed looms or warp-wave looms, as is known, form together with the so-called wave shed weaving machines, the species of multi-phase weaving machines of looms wherein there are continuously inserted a number of mutually stepwise shifted or staggered weft threads in likewise stepwise shifted and traveling sheds. While with the wave shed weaving machines the sheds are simultaneously multiply formed over the width of the fabric and migrate in the weft direction, in the case of the multiple longitudinal traversing shed weaving looms there is formed, in each case, a shed over the entire fabric width and the successively formed sheds simultaneously move in the direction of the warp thread.

During this migration of the sheds in the warp thread direction the formed sheds must be retained, so that the stepwise mutually displaced weft insertion can be accomplished. For this purpose there are used the so-called shed-retaining elements.

A first type of multiple longitudinal traversing shed weaving machine of the previously mentioned type has been disclosed in U.S. Pat. No. 2,742,058, wherein the weaving rotor is formed by alternately arranged polygonal warp thread-support disks and separation disks. The warp thread-support disks serve for both shed formation and also as shed-retaining elements and therefore, depending upon the desired weave, i.e. pattern to be woven, are arranged shifted through an angle. The warp threads extend from the warp beam, through a stationary reed, to the individual warp thread-supporting disks.

This state-of-the-art first type of multiple longitudinal traversing shed loom was not adopted in practice, and specifically, primarily because each weaving pattern change required restructuring of the weaving rotor.

To avoid this drawback there has been proposed in U.S. Pat. No. 3,848,642 a multiple longitudinal traversing shed loom wherein there is arranged forwardly of the region of the sheds a control means in order to laterally deflect each warp thread, according to a predetermined program, and therefore, to allocate a shed-retaining element which is responsible for the upper shed or lower shed. Each shed-retaining element possesses a thread support located at the height of the upper shed or lower shed. Each shed-retaining element is provided in each case for a multiplicity of warp threads, so that for instance during linen weave for warp threads come to bear in each instance upon each support.

With this prior art second type of multiple longitudinal traversing shed loom the weaving rotor need not be restructured each time there is a change in the cloth or fabric pattern which is to be woven, but on the other hand the beat-up elements, which are not particularly discussed in the aforementioned U.S. Pat. No. 3,848,642, must drop into the warp threads located in the upper shed position. This, in turn, can result in leasing errors which are also known in the case of wave shed weaving looms working with rotatable reeds. Additionally, the allocation of a multiplicity of warp threads in each case to a thread support leads to the undesirable result that the warp threads must be shifted over a relatively large path. In those instances where this displacement path reaches the range of the stroke of conventional shed-forming means, this can undesirably sensitively limit the output of such multiple longitudinal traversing shed loom.

SUMMARY OF THE INVENTION

Therefore, with the foregoing in mind it is a primary object of the present invention to provide a new and improved construction of a multiple longitudinal traversing shed loom which is not afflicted with the aforementioned drawbacks and limitations of the prior art proposals discussed above.

Another and more specific object of the present inention is directed to a novel construction of multiple longitudinal traversing shed weaving apparatus whose weaving rotor, when changing fabric patterns, need not be restructured or rebuilt, and wherein there cannot arise any leasing or threading errors or the like due to dropping or dipping of the beat-up elements into the warp threads which have already assumed the upper shed position or lower shed position.

Yet a further significant object of the present invention is directed to providing a loom of the type described which is relatively simple in construction and design, economical to manufacture, extremely reliable in operation, not readily subject to breakdown or malfunction and requires a minimum of maintenance and servicing.

Now in order to implement these and still further objects of the invention, which will become more readily apparent as the description proceeds, the invention contemplates operatively associating with each intermediate space between two neighboring beat-up elements a respective shed-retaining element which determines the upper shed position or lower shed position. Further, in the direction of travel of the warp threads there is arranged a control means, forwardly of the weaving rotor, serving for the lateral deflection and selective allocation of each warp thread to a shed-retaining element which determines the upper shed position or lower shed position.

Since with the inventive solution there are now provided, instead of a single shed-retaining element for a number of tubes, as the intermediate space between neighboring beat-up or beating elements is usually referred to, two respective shed-retaining elements for each tube, the warp threads extend in a more orderly fashion, or, stated in another way, are more uniformly distributed over the length of the weaving rotor, so that the immersion or dipping of the beat-up elements no longer is associated with any problems. Additionally, by appropriately controlling the control means it is possible to fabricate any random cloth pattern or design, without the need to restructure or otherwise modify the weaving rotor.

A first preferred embodiment of the invention is manifested by the additional features that at the weaving rotor there is arranged a respective guide element for the warp threads between each two respective beat-up elements which follow one another in the direction of rotation of the rotor. The line of alignment of such guide elements is located within the intermediate space between beat-up elements which neighbor one another in the weft insertion direction.

In contrast to all heretofore known weaving rotors of multiple longitudinal traversing shed reeds and rotary reeds of wave shed looms, the aforementioned construction offers a decisive advantage. With all of these loom constructions there exists the problem of leasing or drawing-in the warp threads into the correct tube. Previously, attempts were made to solve this problem in that, a guide reed was arranged at as small as possible spacing from the elements which dropeed down into the warp threads, wherein the individual lamella or leaves or the like of such guide reed wherein alignment to the extent possible with such elements. It was hoped that a warp thread reposing between two lamellae of the guide reed, with exact alignment of such lamellae with the dipping elements, would come to lie also in the proper tube. Practical experience however has shown that this expectation could not be fulfilled with wave shed weaving looms using rotary reeds.

With a preferred constructional embodiment of the inventive multiple longitudinal traversing shed loom the guide teeth now are not in alignment with the beat-up elements, rather their line of alignment is located in the intermediate space between such beat-up elements in other words within the related tube or channel. In conjunction with the control means serving for the lateral deflection of the warp threads in the weft insertion direction this leads to the beneifical result that each warp thread bears, from the left or the right, against its guide tooth, and thus, is positively drawn or leased into the correct tube of the beat-up elements.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
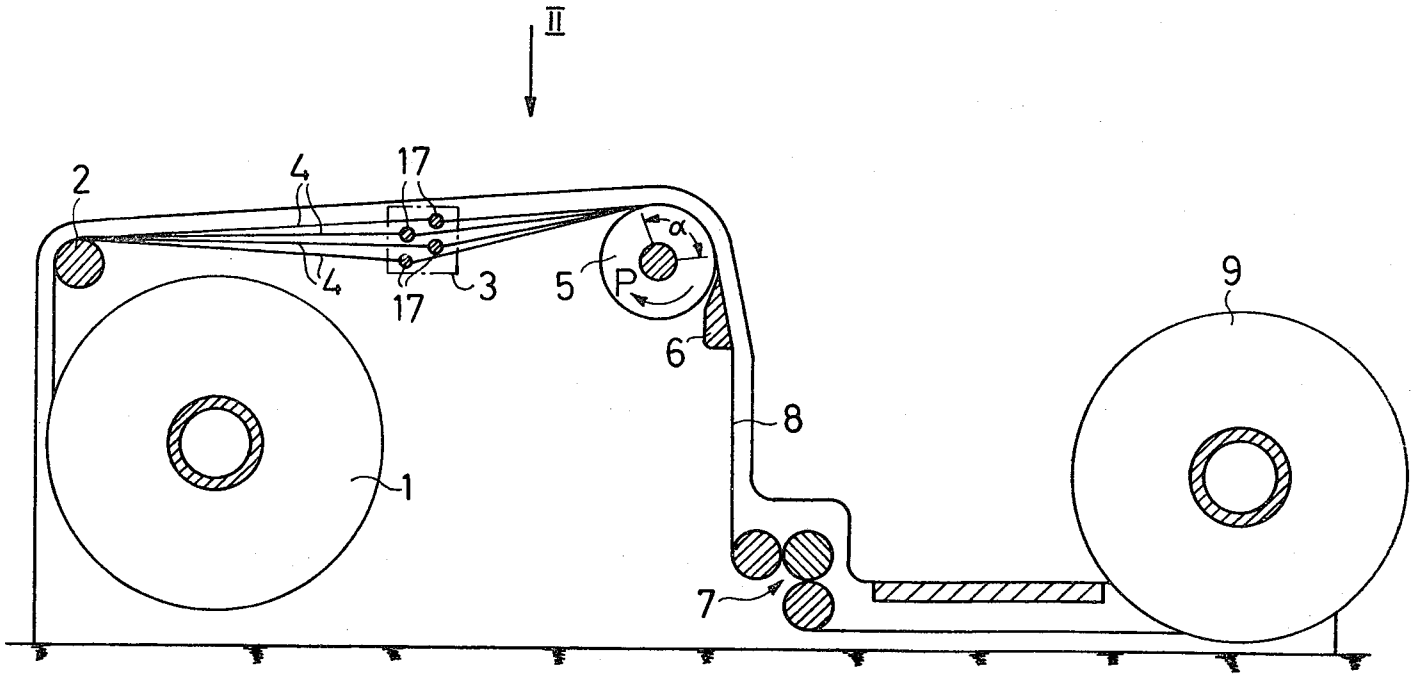
FIG. 1 is a schematic cross-sectional view through a multiple longitudinal traversing shed weaving apparatus or loom according to the invention.
Figure 2:
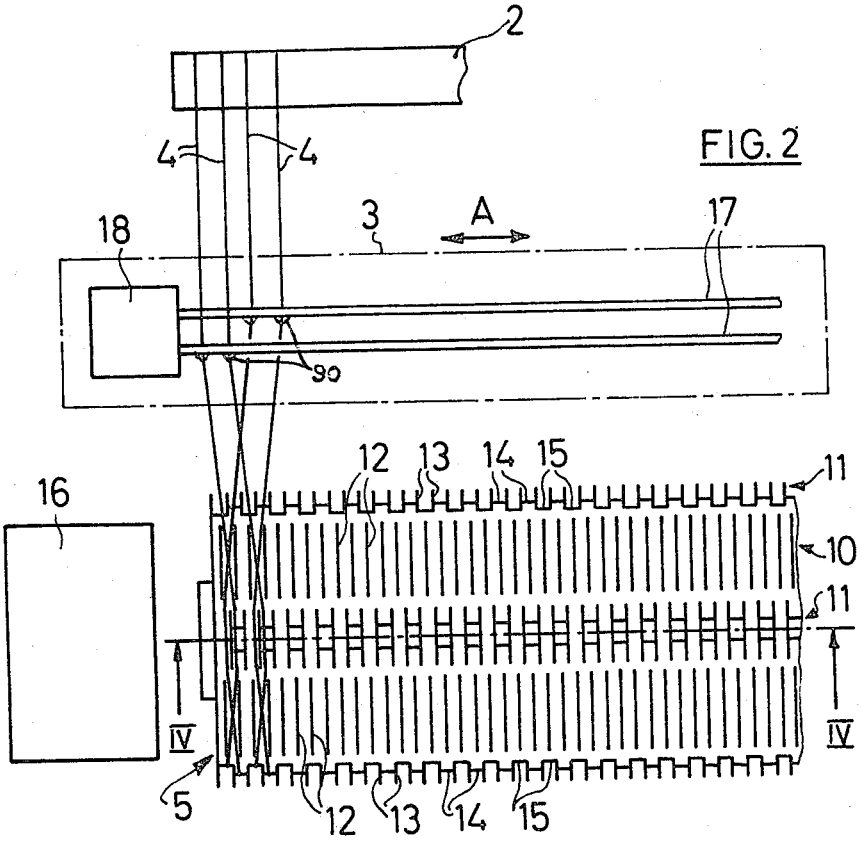
FIG. 2 is a schematic view looking in the direction of the arrow II of the loom of FIG. 1.

Describing now the drawings, it is to be understood that to simplify the illustration thereof only enough of the construction of the loom has been shown to enable those versed in the art to readily understand the underlying principles and concepts of the invention. Turning attention now to FIGS. 1 and 2 the multiple longitudinal traversing shed weaving loom disclosed therein will be seen to essentially comprise a warp beam 1, a back rest or beam 2, a control device or means 3 for the lateral deflection of the warp threads 4, in order to allocate such, in accordnce with a predetermined fabric or cloth pattern, to an upper shed position or lower shed position. Additionally, there is provided a weaving rotor 5, a breast beam 6, a take-off device or mechanism 7 for the woven fabric or cloth 8 and a cloth beam 9.

The weaving rotor 5, rotating during operation in the direction indicated by the arrow P, is of substantially roll or cylindrical configuration and is provided at its circumference, viewed in the direction of rotation P, alternately with lamellae or leaf reeds or combs 10 and 11 extending in the lengthwise direction of the weaving rotor 5, and thus, in the weft laying or insertion direction. The lamellae reeds or combs 10 consist of beat-up lamellae or leaf members 12 serving for beating the inserted weft threads. The lamellae reeds or combs 11 consist of guide lamellae or leaf members 13 between which there are alternately arranged the shed-retaining elements 14 and 15 which determine the upper shed position or lower shed position, respectively, of the warp threads 4. By means of the shed-retaining or holding elements 14 and 15 the warp threads 4 are retained, over the entire wrap angle $\alpha$ of approximately 120°, in their upper shed position or lower shed position. The thus formed sheds successively travel towards the fell of the fabric or cloth, and in the time where the sheds are open there is inserted in a stepwise mutually offset fashion to one another into each shed a weft thread.

Adjacent one of the end faces of the weaving rotor 5 there is arranged a unit or device 16 for preparing and inserting the weft threads. This device 16 does not constitute subject matter of the invention and therefore need not here be further considered. It is however mentioned that any suitable weft insertion system can be used in conjunction with the weaving rotor 5, whether such be a weft insertion system working with shuttles, gripper shuttles, projectiles, to-and-fro moving rods or tapes or with a fluid medium. Such type conventional weft insertion systems, used in conjunction with multiple longitudinal traversing shed weaving looms have been disclosed in German Pat. No. 1,089,695 and in each of U.S. Pat. Nos. 2,742,058, 3,848,642, 4,122,871, 4,122,872 and 4,129,153, to which reference may be readily had and the disclosure of which is incorporated herein by reference.

Continuing, by reverting to FIG. 2 it will be apparent that along the outer shell or surface of the weaving rotor 5, on the one hand, the beat-up lamellae or elements 12 of the lamellae reeds 10 are in alignment with one another and, on the other hand, the guide lamellae or elements 13 of the lamellae reeds 11 are in alignment with one another, and that the lines of alignment of the individual guide lamellae or elements 13 extend in the center of the intermediate space, the so-called tube, of the related beat-up lamellae or elements 12, and the lines of alignment of the beat-up lamellae or elements 12 extend in the center of the tube of the related guide lamellae or elements 13. Also it will be additionally seen that the shed-retaining elements 14 are in alignment with one another and equally the shed-retaining elements 15 are in alignment with one another.

The control device or control means 3 comprises a number of, for instance as shown four rods or bars 17, arranged parallel to the weft insertion direction. The rods 17 are connected with an actuation device 18 and can be moved to-and-fro thereby in the direction of the double-headed arrow A. The rods 17 are equipped with conventional guide eyelets, merely schematically indicated by reference character 90 in FIG. 2 for the warp threads 4, so that the latter, during movement of the rods 17 in their lengthwise direction, are laterally deflected. The number of rods 17 depends upon the nature of the fabric pattern which is to be woven, and in the case of linen weaves it is sufficient to use two such rods 17, while with more complicated patterns or fabric weaves there must be employed a corresponding greater number of such rods or bars 17. The actuation device 18 is in the nature of conventional control mechanism for dobby looms, such as typified by U.S. Pat. No. 3,171,445, granted Mar. 2, 1965 and U.S. Pat. No. 4,154,268, granted May 15, 1979, to which reference may be had and the disclosure of which is incorporated herein by reference, which, in accordance with a predetermined program, moves each of the rods 17, corresponding to a conventional harness or harness frame, into one of both end positions prior to each dipping of one of both lamellae reeds 10 or 11 into the warp threads 4. In such terminal or end position the related warp thread 4 is located within its tube at the left or at the right of the lamellae or elements 12 or 13, as the case may be, which bounds such tube, and therefore, owing to the displacement through one-half of the tube pitch between the successive lamellae reeds 10 and 11, will be positively leased or drawn into the correct tube of the next lamellae reed.

The difference between the control device 3 and a conventional shed forming mechanism by means of a dobby loom and harnesses or harness frames resides essentially in three points worthy of enumeration:

(1) The mass of a rod 17 is appreciably less than that of each conventionally known harness or harness frame, so that for the displacement thereof quite considerably less energy is required in relation to a harness frame.

(2) The dimensions of a rod 17 are appreciably smaller than that of each known harness frame, so that within the same space there can be accommodated quite a larger number of rods 17.

(3) The displacement path, in other words the stroke of the rod 17 only amounts to a fraction of a normal harness stroke, since such displacement path is not dependent upon the shed opening, rather only must cause pivoting or deflection of a warp thread from the one to the other bounding lamellae or element of a tube. Therefore, the displacement of the rod 17 can be accomplished in a considerably shorter amount of time than the displacement of a conventional harness frame and the frequency of the displacements of the rod 17, in comparison to the frequency of the stroke movements of conventional harness frames which, already at the present time, limit the output of single-phase high production looms, can be increased by a multiple.

Now based upon the showing of FIG. 3 there will be explained in greater detail the leasing or drawing-in of the warp threads 4 in the weaving rotor 5. In such FIG. 3 there have been schematically illustrated two lamellae reeds $\mathbf{11}_1$ and $\mathbf{11}_2$ having the guide lamellae or elements 13 as well as the lamellae reed 10 extending therebetween and equipped with the beat-up lamellae or element 12. The warp threads 4, shown by a double line, located in each case in the upper shed position in the lamellae reed $\mathbf{11}_1$ which has dipped already for sometime into the warp threads, are guided by the rods $\mathbf{17}_1$. On the other hand, the warp threads 4, shown with a single line, are located in the lamellae reed $\mathbf{11}_1$ in each case in the lower shed position and are guided by the rods $\mathbf{17}_2$. As already stated, for reasons of clarity in illustration both of the other rods 17, shown in FIG. 1, have been omitted, so that in the lamellae reed 10 each second tube does not have any warp thread 4 and in the lamellae reed 11 each tube only has one warp thread 4.

It is assumed that the lamellae reed 10 as well as the lamellae reed $\mathbf{11}_1$ has completely dipped into the warp threads 4 and that the lamellae reed $\mathbf{11}_2$ will shortly dip into the warp threads 4, and the warp threads 4 guided by the rods $\mathbf{17}_1$ should reach the lower shed position and the warp threads 4 guided by the rods $\mathbf{17}_2$ should reach the upper shed position.

To achieve this result the rods $\mathbf{17}_1$ and $\mathbf{17}_2$ must be moved by the actuation device 18 (FIG. 2) in such a manner that the warp threads 4, guided by such rods, must assume the position illustrated in full lines. The warp threads 4 guided by the rod $\mathbf{17}_1$ are thus moved towards the left and the warp threads 4 guided by the rod $\mathbf{17}_2$ are moved towards the right, until they bear at the beat-up lamellae 12 which bound thereto at the left and right, respectively. In this way the guide lamellae or elements 13 can enter in each case between two spread apart warp threads 4 into the sheet of warp threads. Furthermore, the one of these two spread apart warp threads 4 always arrives into a tube of the lamellae reed $\mathbf{11}_2$ equipped with a shed-retaining element 14 for the upper shed position and the other warp thread arrives in a tube, the lamellae reed $\mathbf{11}_2$ having a shed-retaining element 15 for the lower shed position.

If the warp threads 4 in the lamellae reed $\mathbf{11}_2$, guided by the rod $\mathbf{17}_1$, should arrive at the upper shed position and the warp threads 4, guided by the rod $\mathbf{17}_2$, should arrive at the lower shed position, then the rod $\mathbf{17}_1$ must be moved in the direction of the arrow B and the rod $\mathbf{17}_2$ in the direction of the arrow C, so that the warp threads 4 assume the broken line and chain-dot line positions, respectively.

Figure 3:
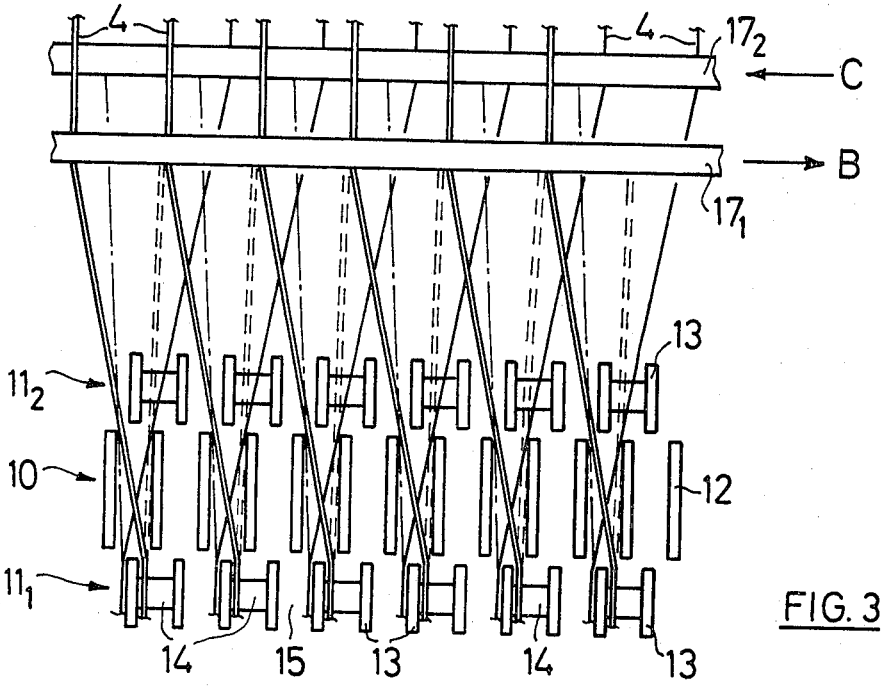
FIG. 3 is a sectional view, on an enlarged scale, showing details of the arrangement of FIG. 2.

The displacement path of the rods $\mathbf{17}_1$ and $\mathbf{17}_2$ between both of the warp thread positions, appears in FIG. 3, owing to the scale and the exaggerated large shown thickness of the lamellae or elements 12 and 13 and equally because of the exaggeratedly large shown tube width in the lameallae reeds 10 and 11, appreciably larger than in reality. In fact, this displacement path amounts to only a few millimeters and, as a general rule, is clearly below 10 millimeters.

Figure 4:
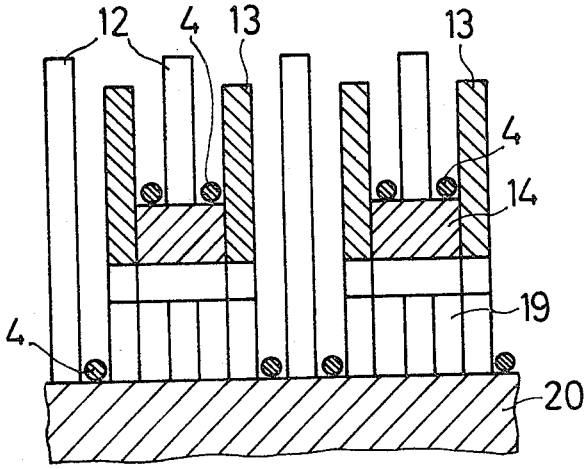
FIG. 4 is a cross-sectional view, taken substantially along the line IV—IV of FIG. 2.
Figure 6:
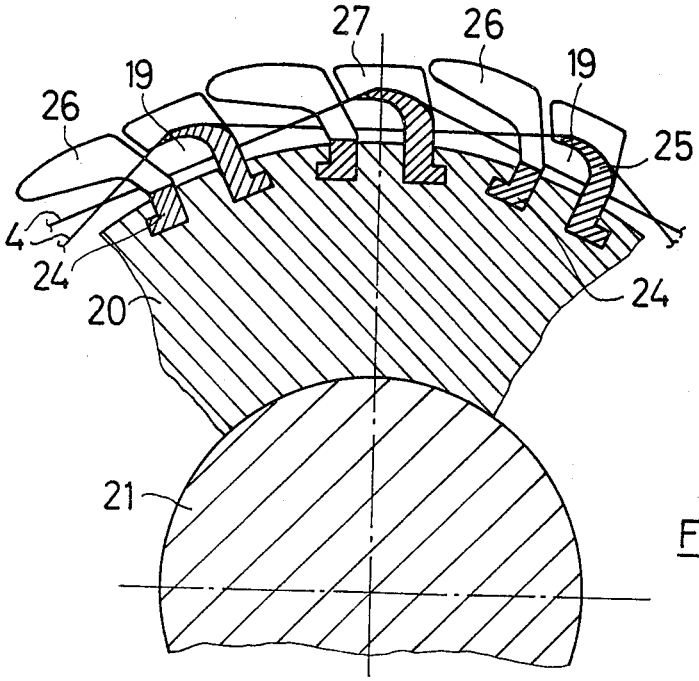
FIG. 6 is a fragmentary cross-sectional view of the weaving rotor portrayed in FIG. 5.
Figure 5:
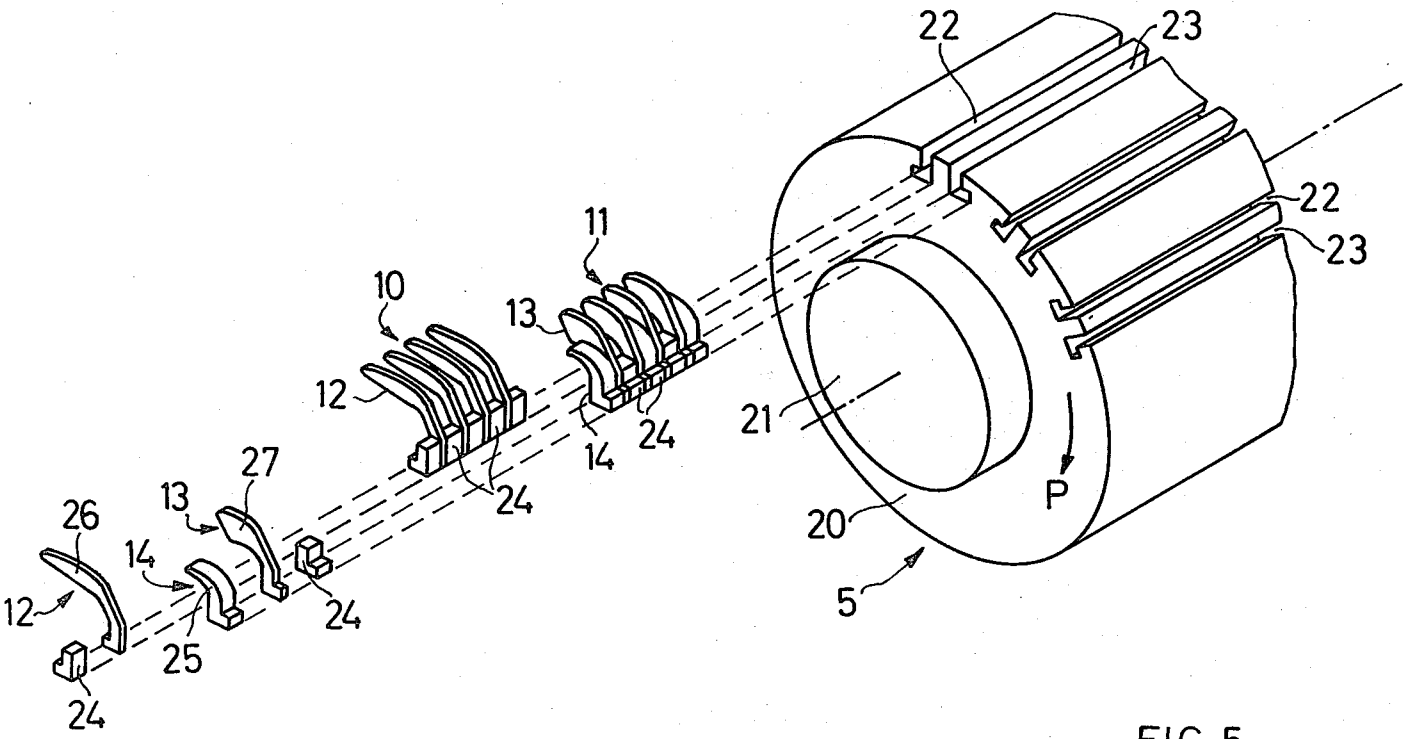
FIG. 5 is a schematic perspective view of the weaving rotor of the loom illustrated in FIG. 1, certain of the parts thereof being shown in exploded illustration.

Now in FIGS. 4 to 6 the weaving rotor 5 has been illustrated in detail. Such weaving rotor 5 will be seen to comprise, in the embodiment under discussion, a substantially tubular-shaped roll 20 which is connected with a drive shaft 21. The roll 20 is provided at its outer surface or shell with a multiplicity of grooves 22 and 23 extending essentially parallel to the lengthwise axis of the rotor 5, and therefore, essentially parallel to the weft insertion direction. These grooves or slots 22 and 23 serve for receiving the lamellae reeds 10 and 11, respectively. The grooves 22 and 23 have a substantially L-shaped cross-sectional configuration. In each case two grooves 22 and 23 form a related pair, wherein the transverse legs of the L-shaped configured or profiled grooves 22 and 23 are directed away from one another, as best seen referring to FIG. 5. The outer surface or shell of the roll 20 is provided with, for instance, a total of fourteen such pairs of grooves 22 and 23.

Due to this configuration of the weaving rotor 5 composed of the roll or cylinder 20 with the peripheral grooves 22 and 23, it is possible to dispense with the use of the shed-holding elements 15 (FIG. 3) for the lower shed position, since support of the warp threads 4, in such lower shed position, as best seen by referring to FIG. 4, can be accomplished by the outer surface of the roll of roller 20. The individual lamellae reeds 10 and 11, instead of being provided with shed-retaining or holding elements 15 (FIG. 3) for the lower shed position, here are equipped with spacer elements 24, as best seen by referring to FIGS. 5 and 6, which at most slightly protrude past the outer surface of the roll 20.

From the showing of FIGS. 4 and 6 it will be apparent that both the guide lamellae or leaves 13 as well as also the shed-retaining elements 14 for the upper shed position of the warp threads 4 are provided with a recess 19. These recesses 19 form for each lamellae reed 11 a channel for the weft insertion. Additionally, it will be apparent that each two respective guide lamellae or elements 13 alternately bound a shed-retaining element 14 for the upper shed position of the warp threads 4 and a spacer element 24, respectively, and that at each two beat-up lamellae 12 likewise bound a spacer element 24.

Continuing, as best seen by referring to FIG. 4 the beat-up lamellae or elements 12 of the neighboring lamellae reed in each case are in alignment with the center of the tube of the lamellae reed formed by the guide lamellae or elements 13. As clearly shown in the illustration there is located in each tube of each of both lamellae reeds 10 and 11 two warp threads 4, in the tube between two guide lamellae or elements 13 there are conjointly located both of the warp threads 4 either in the upper shed position or in the lower shed position, and in the tube between two beat-up lamellae 12 there is located in each case a warp thread 4 in the upper shed position and the other warp thread is located in the lower shed position. This illustration corresponds to the use, indicated in FIG. 1, of four rods 17. On the other hand, in FIGS. 2 and 3 there have been shown for sake of clarity in illustration only two rods 17. Hence, each second tube is empty between the beat-up lamellae 12. It is here further still mentioned that the arrangement of the warp threads 4, illustrated in FIG. 4, corresponding to a double stitch linen weave, is random and that with the illustrated weaving rotor 5 together with the control device 3 it is possible to realize all conceivable cloth pattern variations between both of the extreme values, namely: all of the warp threads in the upper shed position or all of the warp threads in the lower shed position.

Each lamellae reed 11 is formed of shed-retaining elements 14 for the upper shed position, guide lamellae or elements 13 and spacer elements 24. The lamellae reeds 10 are constructed from spacer elements 24 and beat-up lamellae or elements 12. As best seen by referring to FIG. 5, the shed-retaining elements 14 and the spacer elements 24 are appreciably thicker or wider than the beat-up and guide lamellae 10 and 13, respectively. Preferably, the thickness of the shed-retaining elements 14 arranged between the lamellae or leaves or equivalent structure of the one lamellae reed 11 or 10 and/or the spacer elements 24 amount to three times the thickness of the lamellae of the other lamellae reed 11 and 10, as the case may be.

The individual elements of each lamellae reed 10 and 11 are for instance connected by a suitable adhesive so as to form reed portions of, for instance, 100 mm length and these reed portions are inserted into the corresponding grooves 22 or 23 and fixed therein. Upon changing the lamellae density it is possible to simply exchange the individual lamellae reeds 10 or 11, without having to dismantle the entire weaving rotor 5.

The individual elements forming the lamellae reeds 10 and 11 each have a base portion, whose cross-section is accommodated to that of the grooves 22 and 23. The spacer or distance elements 24 are dimensioned such that they do not or only slightly protrude, by means of their upper end, past the outer surface of the roll or cylinder 20. The shed-retaining elements 14 for the upper shed position, the beat-up lamellae or elements 12 and the guide lamellae or elements 13 possess, following their base portion, a respective upper portion 25, 26 or 27 protruding past the outer surface of the roll 20.

The upper portion 25 of the shed-retaining elements 14 for the upper shed position has the shape of a finger which is curved opposite to the direction of rotation P of the weaving rotor 5, whose outer curved surface forms the support for the warp threads 4 in their upper shed position and whose inner curved surface, viewed from the front, bounds the guide channel 19 for the weft insertion from the top and from the front in the direction of rotation P. At its lower region the guide channel 19 is bounded by the outer surface or shell of the roller cylinder 20, towards the rear by the beat-up elements 12 of the neighboring lamellae reed 10.

The upper portion 27 of the guide lamellae 13 has the configuration of a parallelogram-shaped vane, which is provided at its edge confronting the roll or cylinder 20 with a contour or shape corresponding to the inner curvature surface of the finger-shaped upper portion 25 of the shed-retaining elements 14 for the uppr shed position, this contour equally bounding the channel 19 from the top and from the front.

The upper portion 26 of the beat-up lamellae 12 has a sickle-like configuration. The tip of the sickle is directed rearwardly opposite to the direction of rotation P of the weaving rotor 5. The outer edge of this upper portion 26 serves for beating the inserted weft threads, and therefore, protrudes from all of the aforementioned upper portions furthest in radial direction away from the outer surface of the roll 20. The outer edge of the upper portion or part 27 of the guide lamellae 13 is located somewhat closer to the roll 20 and the outer curvature surface of the finger-shaped upper portion or part 25 is located somewhat below one-half of the distance between the outer surface of the roll 20 and the outer edge of the upper portion 26 of the beat-up lamellae 12 which beats the laid weft threads.

As best seen by referring to FIG. 6, the configuration and dimensions of the lamellae or elements 12 and 13 and the mutual spacing of the grooves 22 and 23, and therefore, that of the lamellae reeds 10 and 11, is chosen such that between the individual lamellae reeds there is only a small spacing amounting to about 1 mm or less.

Of course, the weaving rotor 5, instead of being structured in the described manner, also could be formed in the manner of a conventional rotational or rotary reed, as is known from the wave shed loom art, of individual lamellae in the form of circular plates provided with projections. This type of weaving rotor must, however, practically be completely dismantled, knocked-down, reassembled and again installed, whenever there is a change in the article which is being fabricated at the loom.

While there are shown and described present preferred embodiments of the invention, it is to be distinctly understood that the invention is not limited thereto, but may be otherwise variously embodied and practiced within the scope of the following claims. Accordingly,

What I claim is:

1. A multiple longitudinal traversing shed weaving loom comprising:

a rotatable weaving rotor over which pass warp threads moving in a predetermined direction of travel;

beat-up elements provided for the weaving rotor for bearing weft threads inserted through the warp threads;

shed-retaining elements for holding the warp threads over a predetermined path in selective upper and lower shed positions;

said beat-up elements being spaced from one another to form between each two neighboring beat-up elements an intermediate space;

a respective one of said shed-retaining elements for determining the upper shed position or lower shed position being operatively associated with each intermediate space between neighboring beat-up elements;

control means arranged forwardly of the weaving rotor with respect to the direction of travel of the warp threads;

said control means serving for the lateral deflection and random correlation of each warp thread to a shed-retaining element which determines the upper shed position or lower shed position;

a respective guide element for the warp threads arranged at the weaving rotor between each two beat-up elements which follow one another in the direction of rotation of said weaving rotor; and the guide elements being oriented such that the line of alignment thereof is located within the intermediate space between beat-up elements neighboring one another in the direction of weft insertion.

2. The loom as defined in claim 1, wherein:

the line of alignment of each guide element extends essentially through the central plane of the intermediate space between neighboring beat-up elements.

3. The loom as defined in claim 2, wherein:

said beat-up elements are arranged essentially equidistantly along the circumference of the weaving rotor in the form of first lamellae reeds;

said first lamellae reeds extending essentially parallel to the lengthwise axis of the weaving rotor;

a respective second lamellae reed formed of said guide elements and arranged between each two successive first lamellae reeds; and said second lamellae reeds extending essentially parallel to the lengthwise axis of the weaving rotor.

4. The loom as defined in claim 3, wherein:

said shed-retaining elements are arranged within each second lamellae reed; and one of said shed-retaining elements for the upper or lower shed position being alternately arranged between two neighboring guide elements.

5. The loom as defined in claim 4, wherein:

said weaving rotor has an outer surface;

said beat-up elements of the first lamellae reeds and the guide elements of the second lamellae reeds being arranged along circumferential circles at the outer surface of the weaving rotor; and the circumferential circles correlated to both of the lamellae reeds being shifted in relation to one another by one-half of the pitch of the lamellae reeds.

6. The loom as defined in claim 5, wherein:

the shed-retaining elements for the upper shed position and the shed retaining elements for the lower shed position are each respectively arranged along circumferential circles upon the outer surface of the weaving rotor.

7. The loom as defined in claim 3, wherein:

said weaving rotor comprises a substantially tubular-shaped roll having an outer surface;

said outer surface of said roll being provided with grooves extending essentially parallel to the lengthwise axis of the weaving rotor and serving for the reception of the beat-up elements and the shed-retaining elements.

8. The loom as defined in claim 7, wherein:

the shed retaining elements for the lower shed position are replaced by spacer elements which at the most slightly protrude past the outer surface of the roll; and said spacer elements forming supports for the warp threads in the lower shed position.

9. The loom as defined in claim 7, wherein:

each of the shed-retaining elements for the upper shed position possess at a part thereof protruding past the outer surface of the roll the shape of a finger which is curved opposite to the direction of rotation of the weaving rotor;

said finger having an outer curvature surface serving as support means for the warp threads in their upper shed position; and said finger having an inner curvature surface delimiting a guide channel for the weft insertion from the top and from the front viewed in the direction of rotation of the weaving rotor.

10. The loom as defined in claim 9, wherein:

the guide channel for the weft insertion is bounded at its lower region by the outer surface of the roll and in the direction of rotation of the weaving rotor towards the rear by beat-up elements of a neighboring first lamellae reed.

11. The loom as defined in claim 9, further including:

a respective guide element for the warp threads arranged at the weaving rotor between each two beat-up elements which follow one another in the direction of rotation of said weaving rotor;

the guide elements being oriented such that the line of alignment thereof is located within the intermediate space between beat-up elements neighboring one another in the direction of weft insertion;

the guide elements possessing at a part thereof protruding past the outer surface of the roll the configuration of a parallelogram-shaped vane;

said vane having a contour at an edge thereof confronting the roll which corresponds to the inner curvature surface of the finger-shaped part of the shed-retaining elements for the upper shed position and which bounds the guide channel from the top and from the front.

12. The loom as defined in claim 7, wherein:

the shed-retaining elements for the lower shed position are replaced by spacer elements which at most slightly protrude past the outer surface of the roll; and the outer surface of the roll forming supports for the warp threads in the lower shed position.

13. The loom as defined in claim 7, wherein:

one of the grooves serves for the reception of the first lamellae reeds and the other groove serves for the reception of the second lamellae reeds.

14. The loom as defined in claim 13, wherein:

the outer surface of said roll is provided with between ten and twenty pairs of said grooves.

15. The loom as defined in claim 14, wherein:

fourteen pairs of said grooves are provided at the outer surface of said roll.

16. The loom as defined in claim 13, further including:

a respective spacer element provided within the first lamellae reed between each two neighboring beat-up elements.

17. The loom as defined in claim 16, wherein:

the beat-up elements and the guide elements have essentially the same thickness; and the thickness of the shed-retaining elements for the upper shed position and the spacer elements each amount to approximately three times the thickness of the beat-up elements.

18. The loom as defined in claim 17, wherein:

the mutual spacing of the lamellae reeds at most amounts to 2 millimeters.

19. The loom as defined in claim 18, wherein:

said mutual spacing amounts to approximately 1 millimeter.

* * * * *